US006527574B1

(12) United States Patent
Murakami et al.

(10) Patent No.: US 6,527,574 B1
(45) Date of Patent: Mar. 4, 2003

(54) WATERPROOF CONNECTOR AND METHOD FOR ASSEMBLING SAME

(75) Inventors: Takao Murakami, Shizuoka-ken (JP); Masaru Fukuda, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/281,272

(22) Filed: Mar. 30, 1999

(30) Foreign Application Priority Data

Mar. 31, 1998 (JP) ..... 10-087584

(51) Int. Cl.[7] ..... H01R 13/52

(52) U.S. Cl. ..... 439/275; 439/426

(58) Field of Search ..... 439/275, 426, 439/272

(56) References Cited

U.S. PATENT DOCUMENTS

| | | | | |
|---|---|---|---|---|
| 3,879,239 A | | 4/1975 | Rager et al. | 156/73.1 |
| 4,083,902 A | | 4/1978 | Clyde | 264/26 |
| 4,640,567 A | | 2/1987 | Lundergan et al. | 339/94 |
| 4,643,506 A | | 2/1987 | Kobler | 339/94 |
| 4,662,692 A | | 5/1987 | Uken et al. | 439/426 |
| 4,684,187 A | | 8/1987 | Rudy, Jr. et al. | 439/600 |
| 4,708,662 A | | 11/1987 | Klein | 439/353 |
| 4,713,021 A | | 12/1987 | Kobler | 439/272 |
| 4,776,813 A | | 10/1988 | Wilson et al. | 439/587 |
| 4,944,688 A | | 7/1990 | Lundergan | 439/275 |
| 4,969,260 A | | 11/1990 | Kondo et al. | 29/863 |
| 4,976,634 A | | 12/1990 | Green et al. | 439/589 |
| 4,979,913 A | | 12/1990 | Aiello et al. | 439/596 |
| 5,116,236 A | | 5/1992 | Colleran et al. | 439/271 |
| 5,120,269 A | | 6/1992 | Endo et al. | 439/752 |
| 5,215,635 A | | 6/1993 | Stein et al. | 204/157.62 |
| 5,240,431 A | | 8/1993 | Yagi et al. | 439/271 |
| 5,266,045 A | | 11/1993 | Yamamoto et al. | 439/275 |
| 5,316,504 A | | 5/1994 | Jinno | 439/752 |
| 5,419,722 A | | 5/1995 | Onoda | 439/752 |
| 5,490,572 A | | 2/1996 | Tajiri et al. | 180/65.1 |
| 5,498,170 A | | 3/1996 | Tanaka | 439/271 |
| 5,529,508 A | | 6/1996 | Chiotis et al. | 439/204 |
| 5,562,477 A | | 10/1996 | Moore et al. | 439/383 |
| 5,567,170 A | * | 10/1996 | Kroeber | 439/272 |
| 5,569,050 A | | 10/1996 | Lloyd | 439/465 |
| 5,580,264 A | * | 12/1996 | Aoyama et al. | 439/275 |
| 5,596,261 A | | 1/1997 | Suyama | 320/48 |
| 5,613,868 A | | 3/1997 | Ohsumi et al. | 439/275 |

(List continued on next page.)

FOREIGN PATENT DOCUMENTS

| | | |
|---|---|---|
| EP | 0 299 797 | 1/1989 |
| EP | 0 546 753 A1 | 6/1993 |
| EP | 0 631 344 A2 | 6/1994 |

(List continued on next page.)

OTHER PUBLICATIONS

European Search Report dated Jul. 9, 1999.

*Primary Examiner*—P. Austin Bradley
*Assistant Examiner*—Briggitte R. Hammond
(74) *Attorney, Agent, or Firm*—Finnegan, Henderson, Farabow, Garrett, & Dunner, L.L.P.

(57) ABSTRACT

A housing (11) of a waterproof connector (10) comprises a housing body (15), and a terminal housing (17) assembled in a water sealing manner to the housing body (15) and provided with a terminal accommodation portion (16) for accommodating terminals (13). The housing body (15) has a sealing material accommodation chamber (20) for accommodating a soft sealing material (14), insertion holes (21) provided for inserting electric wires (12) through an inner wall **(11*a*) on which the soft sealing material (14) accommodated in the sealing material accommodation chamber (20) is tight contacting, and a terminal housing accommodation chamber (23) communicating with the sealing material accommodation chamber (20), for the terminal housing (17) to be fitted therein to push the soft sealing material (14) against the inner wall (11*a*)**.

6 Claims, 2 Drawing Sheets

U.S. PATENT DOCUMENTS

| | | | | |
|---|---|---|---|---|
| 5,645,451 | A | 7/1997 | Ohsumi et al. | 439/587 |
| 5,707,251 | A | 1/1998 | Sakai et al. | 439/589 |
| 5,709,563 | A | 1/1998 | Saito | 439/275 |
| 5,730,627 | A | 3/1998 | Okabe | 439/752 |
| 5,782,657 | A | 7/1998 | Wolla et al. | 439/595 |
| 5,803,773 | A | 9/1998 | Kashiyama et al. | 439/752 |
| 5,836,788 | A | 11/1998 | Torii | 439/587 |
| 5,860,834 | A | 1/1999 | Sugiyama | 439/595 |
| 5,931,699 | A | 8/1999 | Saito | 439/587 |
| 5,931,707 | A | 8/1999 | Ito | 439/752 |
| 5,947,774 | A | 9/1999 | Abe | 439/701 |
| 5,984,737 | A | 11/1999 | Nagano et al. | 439/752 |

FOREIGN PATENT DOCUMENTS

| | | | |
|---|---|---|---|
| EP | 0 691 710 | A2 | 1/1996 |
| EP | 0 700 125 | A | 3/1996 |
| EP | 0 778 636 | A1 | 6/1997 |
| FR | 2415375 | | 8/1979 |
| FR | 2753008 | | 3/1998 |
| GB | 2 168 548 | A | 6/1986 |
| GB | 2 321 346 | A | 7/1998 |
| GB | 2 321 347 | A | 7/1998 |
| GB | 2 321 792 | A | 8/1998 |
| GB | 2 321 802 | A | 8/1998 |
| JP | 50-54591 | | 5/1975 |
| JP | 61-12621 | | 4/1986 |
| JP | 62-188069 | | 11/1987 |
| JP | 64-63282 | | 3/1989 |
| JP | 4-49480 | | 4/1992 |
| JP | 4-101380 | | 9/1992 |
| JP | 5-152028 | | 6/1993 |
| JP | 6-217412 | | 8/1994 |
| JP | 6-295750 | | 10/1994 |
| JP | 7-22079 | | 1/1995 |
| JP | 7-201395 | * | 4/1995 |
| JP | 7-122331 | | 5/1995 |
| JP | 07201395 | | 8/1995 |
| JP | 7-298450 | | 11/1995 |
| JP | 7-326424 | * | 12/1995 |
| JP | 07326424 | | 12/1995 |
| JP | 8-186901 | | 7/1996 |
| JP | 9-45376 | | 2/1997 |
| JP | 9-82394 | | 3/1997 |
| JP | 09082394 | | 3/1997 |
| JP | 10-60096 | | 3/1998 |
| JP | 10-92478 | | 4/1998 |
| WO | WO 92/15133 | | 9/1992 |
| WO | WO 96/32760 | | 10/1996 |
| WO | WO 97/36346 | | 10/1997 |

* cited by examiner

WATERPROOF CONNECTOR AND METHOD FOR ASSEMBLING SAME

BACKGROUND OF THE INVENTION

1. Field of the Invention

The present invention relates to a waterproof connector of the type in which terminal accommodating chamber is sealed at a wire outlet side thereof with a "body of soft sealing material" (hereafter called "soft sealing material"), and to a method for assembling the same.

2. Description of the Relevant Art

There have been disclosed such types of waterproof connectors in U.S. Pat. No. 4662692, Japanese Patent Application Laid-Open Publication No. 64-3282, and Japanese Utility Model Application Laid-Open Publication No. 4-101380.

A waterproof connector of the concerned type comprises a plurality of terminal accommodation chambers reduced at front ends for connection to a mating connector, a plurality of terminals accommodated in the terminal accommodation chambers and connected to front ends of wires, and a soft sealing material for a common sealing at a wire outlet end of the terminal accommodation chambers. The soft sealing material comprises a configured body of a gel, such as of silicon, which tight contacts on the wires and inner walls of a straight wire outlet of the housing, and prevents water drops and droplets from invading the terminal accommodation chambers along outer circumferences of the wires and inner walls of the housing.

The soft sealing material is fitted in the wire outlet, and is kept from slipping out by a relatively hard frame as a retainer, which is inserted in the wire outlet and fixed thereto. A plurality of slits are formed through the soft sealing material for letting therethrough the terminals connected to the wires.

For assembling the terminals in the housing, the soft sealing material is pushed in the wire outlet, and accommodated therein in a compressed state tightcontacting on walls of the housing, before the retainer is fixed in the wire outlet. Then, each terminal is applied to and forced forward through a corresponding slit, so it enters a terminal accommodation chamber, dragging a wire along the slit. When the terminal is accommodated, the wire extends through the slit. As the soft sealing material is in the compressed state, an inside circumference of the slit is pressed tight on an outer circumference of the wire. The terminal accommodation chamber is thus kept free from water invasion that otherwise might have occurred along the outer circumference of the wire or along inner walls of the housing.

Each terminal placed in a corresponding terminal accommodation chamber is locked by engagement with a lance projecting inside the chamber from a chamber wall, which lance is flexible within a space in the wall and flexed in a locking position with a spacer inserted in the space. Thus, the terminal is kept from slip-out, in a doubled manner, i.e., by the soft sealing material stopped with the retainer and by the lance flexed with the spacer.

As the terminals are forced through the slits in the soft sealing material, they scrape inner circumferences of the slits, and carry scraps of electrically insulating sealing material into the terminal accommodation chambers. Such scraps constitute obstacles to connection of each terminal with a mating terminal, and provide a reduced conductance therebetween.

The scraped inner circumferences of the slits have reduced tendencies to seal gaps therealong, causing a deteriorated performance of the waterproof connector.

The hard retainer has openings each formed with a dimension large enough for a corresponding terminal to be let therethrough, dragging a wire connected thereto. The opening has to be larger in section than the terminal that may well be larger than the wire, which may be tensed and pulled sideways. A large opening allows for the wire to be flexed directly about a rear edge of a slit, which is formed in the soft sealing material. A flexion of the wire pushes at one side thereof a contacting part of the slit edge, having an excessive clearance developed at the other side, occasionally causing water droplets to slip in, resulting in a reduced sealing performance.

SUMMARY OF THE INVENTION

The present invention has been achieved with such points in view. It therefore is an object of the present invention to provide a waterproof connector and a method for assembling the same, with an effective water sealing free of conventional considerations to scrapes or scraps of a soft sealing material, and/or occasional slip-in of water.

To achieve the object, an aspect of the invention provides a waterproof connector comprising a first housing defining a chamber, a soft sealing body sealing the chamber, an electric wire provided through the soft sealing body, a terminal connected to the electric wire, a second housing accommodating the terminal, and a sealing provided between the first and second housings.

According to this aspect of the invention, a connector housing is divided into a first housing which defines a first chamber sealed with a soft sealing body, and a second housing which accommodates a terminal. An electric wire is inserted through the soft sealing body, and connected to the terminal. The terminal does not need to be forced through the soft sealing body, and will not scrape the soft sealing body nor carry scraps thereof into the second housing. The connector housing is waterproof, as a sealing is provided between the first and second housings of a waterproof connector. The sealing may preferably be provided before, when or after the first and second housings are combined, connected, fastened, fitted, fixed, integrated, joined or screwed to each other.

The chamber may preferably have a sealed end sealed by the soft sealing body, and an open end communicating with an inside of the second housing, and the first housing may preferably have a wall closing the sealed end of the chamber and formed with an insertion hole for passing the electric wire. The wall can prevent an occasional slip-in of water. The insertion hole may preferably be smaller in section than the terminal.

The terminal may preferably have a connection part for connection to the electric wire, and the second housing may preferably have a channel for fitting therein the connection part of the terminal, the channel being open at a lateral side thereof for the electric wire to be laterally pushed therein. The terminal may preferably comprises an insulation displacement terminal.

Further to achieve the object described, another aspect of the invention provides a waterproof connector assembling method comprising providing a first housing defining a chamber, sealing the chamber with a soft sealing body, providing an electric wire through the soft sealing body, connecting a terminal to the electric wire, accommodating the terminal in a second housing, and providing a sealing between the first and second housings. According to this aspect also, there are achieved like effects to that aspect of the invention.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
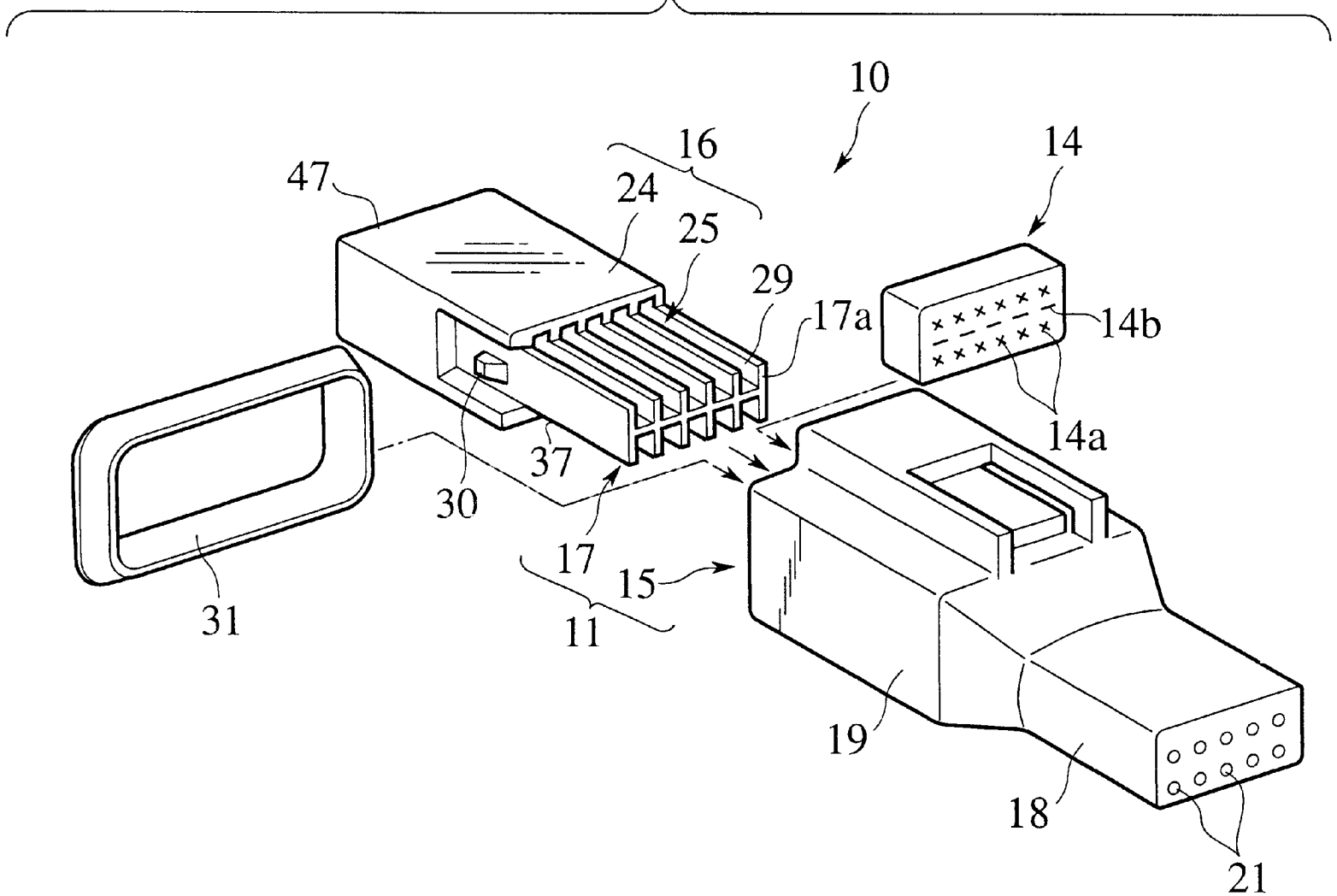
FIG. 1 is an exploded perspective view of a waterproof connector according to an embodiment of the invention, in a state where electric wires and terminals are removed.

There will be detailed below the preferred embodiments of the present invention with reference to the accompanying drawings. Like members are designated by like reference characters.

Figure 2A:
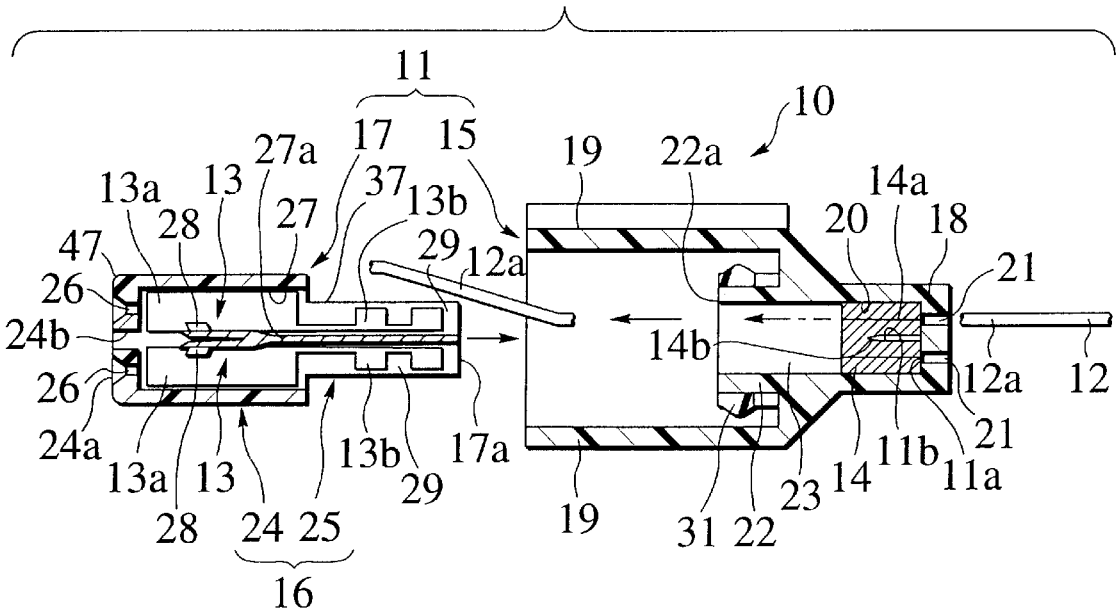
FIG. 2A is a longitudinal section of the waterproof connector in a state before a terminal housing is fitted to a housing body.

An embodiment of a waterproof connector and a method for assembling the same according to the invention will be described below. FIG. 1 is an exploded perspective view showing an appearance of a waterproof connector 10, and FIGS. 2A and 2B show an internal structure of the waterproof connector 10, in which FIG. 2A is an exploded sectional view showing a state before a terminal housing 17 is fitted in a housing body 15, and FIG. 2B is a longitudinal section showing a state after the terminal housing 17 is fitted to end in the housing body 15.

As shown in FIG. 1, the waterproof connector 10 comprises a waterproof housing 11, a pair of upper and lower arrays of multiple terminals 13 (refer to FIGS. 2A and 2B) each connected to an end of a corresponding one of multiple insulated electric wires 12 in the housing 11, and a common soft sealing material 14 accommodated in a wire outlet space of the housing 11 and the sealing material is deformable by compression to tightly contact respective outer circumferences of relatively short lengths of the wires 12 and to tightly contact the entire inner surface of an end wall 11*a* of a base portion 18 of the housing 11 from which the wires 12 protrude as on entire inner surface of a wall 11*a* of a wire-outlet protrusion (as a rear part of, thereby sealing clearances therebetween.

Figure 2B:
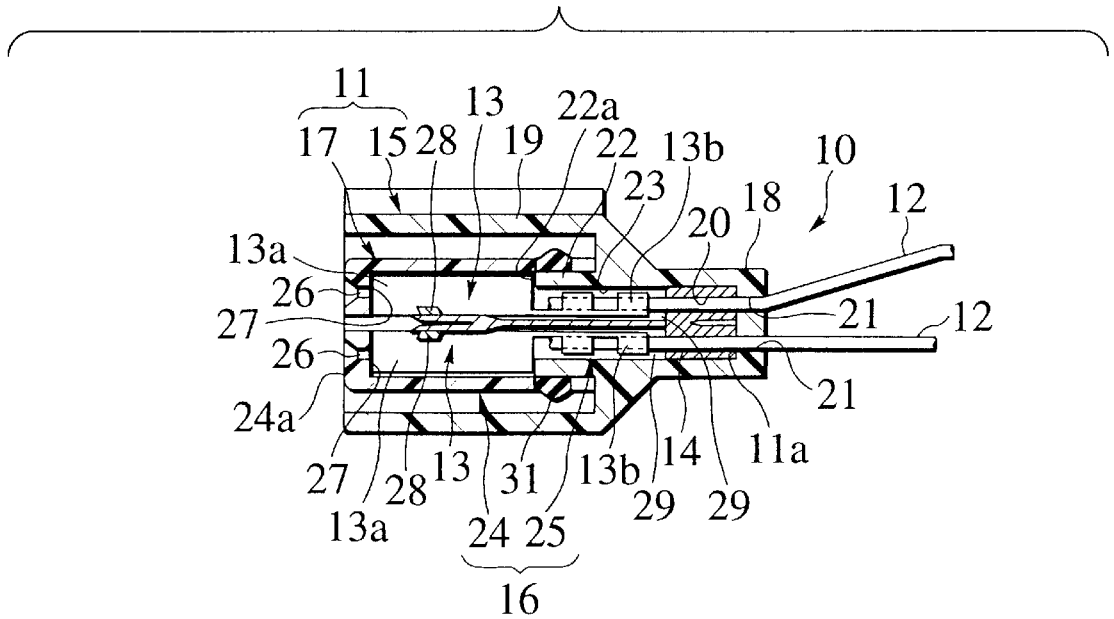
FIG. 2B is a longitudinal section of the waterproof connector in a state after the terminal housing is fitted to the housing body.

In the waterproof connector 10, the housing 11 is divided or separated into a housing body 15 (right-hand in FIG. 2A) and a terminal housing 17 (left-hand in FIG. 2A), until the latter 17 is fitted inside the former 15 as in FIG. 2B. The terminal housing 17 is configured as a terminal accommodation portion 16 (of the housing 11) for the terminals 13 to be accommodated therein.

The terminals 13 are of an insulation displacement type that comprises a contact part 13*a* for electrical contact with a mating contact (not shown), and a connection part 13*b* for a retaining connection to a non-stripped end 12*a* of the insulated electric wire 12.

The connection part 13*b* has one or more pairs of opposing conductive blades which cut an insulator covering a core wire of the wire end 12*a* and directly contact on the core wire, when the wire end is laterally pushed between the blades. The terminals 13 may be any type else, e.g. a solder, crimp or solder-less type.

The soft sealing material 14 comprises a parallelepiped body of a gel, such as of silicon, formed with a pair of upper and lower arrays of multiple through holes 14*a* for the wires 12 to be inserted therethrough before connection to the terminals 13, and an array of central slits 14*b* cut to a depth shorter than a thickness of the soft sealing material 14. The slits 14*b* permit the holes 14*a* to be expanded near their rear ends with ease for application of the wires 12 to be inserted therein. In some case, the slits 14*b* may be expanded to compress the material 14 so that the holes 14*a* have an identical diameter to the wires 12, contacting tight on the wires 12 as well as on associated walls to be sealed.

As shown in FIGS. 2A and 2B, the housing body 15 comprises a parallelepiped hollow base portion 18, and a splash-proof outer hood portion 19 formed integrally on a longitudinally middle part of the base portion 18, with inside dimensions (height×width) each larger than corresponding outside dimensions of the base portion 18 by sufficient differences for a sealing application in between.

The outer hood portion 19 extends forwards, exceeding a front end of the base portion 18 by a sufficient length for the terminal housing 17 to be fully covered when fitted to the base portion 18. Inside the base portion 18 is defined a sealing material accommodation chamber 20, where the soft sealing material 14 is accommodated. A rear end part of the wall 11*a* (of the protrusion) of the base portion 18 has a pair of upper and lower arrays of multiple wire-insertion holes 21 formed therethrough with a diameter that is smaller than a maximum height of a corresponding terminal 13, but is adequate for a corresponding wire 12 to be inserted therethrough. A front part of the base portion 18 is configured as a forward projecting inner hood portion 22 totally surrounded for protection by the outer hood portion 19.

Along a total length of the middle and front parts of the base portion 18, the sealing material accommodation chamber 20 has a corresponding chamber region 23 called "terminal housing accommodation chamber", which is continuous to and communicates with the remaining region of the chamber 20. The region of the chamber 23 is identical in sectional size to the remaining region, but may be extended or reduced. The outer hood portion 19 has a polarity identifying fixing part formed thereon.

The terminal housing 17 is molded in the form of a semi-covered channel array set comprising a channel set 37 composed of a pair of upper and lower arrays of integrated relatively long multiple U-channels 27+29 of which vertically common bottoms 27*a* are open at their front regions, and a relatively short box-like wall 47 integrally covering a front part of the channel set 37 in which respective channelisolating isolating partitions are stepped to have an increased height. The wall 47 is flush at a rear edge thereof with a stepping edge of each partition.

Each channel bottom 27*a* is configured at its front end part to provide a pair of upper and lower normally slight open "split flexible pieces with outside convex latches" 28 called "engagement lances".

In an aspect, the terminal housing 17 comprises a covered mating portion 24 as a waterproof receptacle part to be mated water-tight with a plug part of another multiple-pole waterproof connector, and an uncovered insert portion 25 to be fitted in the terminal-housing accommodation chamber 23 of the housing body 15.

The box-like wall 47 constitutes at a front end thereof a tight-mating face 24*a*, which has formed therethrough a pair of upper and lower arrays of multiple insertion holes 26 for insertion of mating terminals. The face 24*a* has also (a common central slit or) an array of multiple central holes 24*b* for application of (an unshown common mating or independent applicator or) an array of projections to check or ensure that the pairs of engagement lances 28 are flexed in their opening directions. Note that the (common applicator or) projection array can be removed after the check. Inherently, each terminal 13 is self-locked, when its contact part 13*a* has ridden over the latch. The (applicator or) projection array may be left, if desirable in a case.

The wall 47 cooperates with the front part of the channel set 37 to define a pair of upper and lower arrays of electrically isolated contact-part accommodation chambers 27 (i.e. covered regions of the U channels) for accommodating the contact parts 13*a* of the terminals 13.

When the lance pair is opened, each engagement lance 28 is lockingly engageable with a bottom hole or concave in the contact part 13*a* of an associated terminal 13 inserted in position in a corresponding contact-part accommodation chamber 27, to keep the terminal 13 from slipping out.

When the terminal 13 is locked, the contact part 13*a* abuts at its front edge on an inside of the front face 24*a*, and a rear edge of the contact part 13*a* is located inside the box-like wall 47, at a slight distance from the rear edge of the wall 47.

Further, over length of the insert portion 25 of the terminal housing 17, each U channel 29 has a corresponding uncovered region 29 called "wire-connection-part accommodation groove" or simply "wire accommodation groove", for accommodating the wire connection part of an associated terminal 13 to receive a length of the wise end 12*a* to be laterally pushed therein for electrical connection as well as for an ensured retention. As a matter of course, each wire accommodation groove 29 is open along its upper or lower lateral side and at its front and rear ends.

The terminal housing 17 is thus provided as a separate member comprising the box-like wall 47 and the channel set 37 partially fitted therein, or as the terminal accommodation portion 16 of the housing 11 comprising the covered mating portion 24 that defines the contact-part accommodation chambers 27, and the uncovered insert portion 25 that defines the wire-connection-part accommodation grooves 29.

The channel set 37 has a pair of left and right outermost side walls formed with outside projections 30 for locking engagement with notches provided in left and right walls of the base portion 18 or outer hood portion 19 of the housing body 15, to hold the terminal housing 17 in the housing body 15.

As shown in FIG. 2B, when the insert portion 25 is fitted to end inside the terminal-housing accommodation chamber 23, a rear end part 17*a* of the terminal housing 17 presses a front face of the soft sealing material 14 against the inner wall 11*a*. The inner wall may have forward projections 11*b*, which may enter the slits 14*b*, as the sealing material 14 is displaced rearwards. In this case, the material 14 may be positioned and deformed into a compressed sealing configuration, where the through holes 14*a* have an identical diameter to the wires 12, i.e. inner circumferences of the holes 14*a* tight contact on outer circumferences of the wires 12, and outer surfaces of the material 14 tight contact on the inner wall 11*a*. Corners and/or edges of the inner wall 11*a* may be tapered or rounded to effect such deformation, in addition to or in place of the combination of slits 14*b* and projections 11*b*. Deformation of the material 14 may well be sufficient to achieve a compressed sealing configuration with pressures exerted by the rear end 17*a* of the inserted terminal housing 17, and the slits 14*b* may be designed simply for expansion of the through holes 14*a*.

The inner hood portion 22 has tight fitted thereon a rear end gasket, and a waterproof seal packing 31 of which a front end face is normally flush with a front end 22*a* of the inner hood portion 22. The front end 22*a* has upper and lower front edges thereof notched at multiple points corresponding in lateral location to the partitions of the channel set 37. When the terminal housing 17 is inserted to end, in the accommodation chamber 23, the upper and lower edges of the front end 22*a* abut on the rear edges of the contact parts 13*a* of upper and lower terminals 13, so that the rear edge of the box-like wall 47 tight contacts on the sealing packing 31, thereby achieving an effective sealing between the housing body 15 and the terminal housing 17. In addition, the terminals 13 are secured in position.

To this point, the contact parts 13*a* of the terminals 13 may have an equivalent length to an inside length dimension of the box-like wall 47, for abutment with straight edges at the front end 22*a* of the inner hood portion 22 on which a wider seal packing is fitted. Or alternately, the contact parts 13*a* of the terminals 13 may have an equivalent length to a distance between a front end and the stepping edge of each partition, and the box-like wall 47 may have a greater inside length dimension than the distance and its rear edge may exceed the stepping edge of partition, for a compressing abutment on the seal packing 31. Anyway, the terminals 13 are engaged with the front end 22*a* of the inner hood portion 22 and with the engagement lances 28, in a double locking manner. Note that a bulged part of the sealing packing 31 is interposed and compressed between the inner hood portion 22 and a hood portion of the mating connector.

Next, a method for assembling the waterproof connector 10 will be described.

As shown in FIG. 2A, the terminals 13 are accommodated in the terminal accommodation portion 16 of the terminal housing 17, and the wire connection parts 13*b* are accommodated in the wire accommodation grooves 29 in advance. In this state, the soft sealing material 14 is first inserted in the sealing material accommodation chamber 20, and the wires 12 are inserted in the housing body 15 through the wire insertion holes 21.

The wires 12 inserted in the housing body 15 are let through the soft sealing material 14, i.e. provided through the holes 14*a*, and drawn out through the terminal. housing accommodation chamber 23. The wire ends 12*a* are connected to the wire connection parts 13*b* of the terminals 13.

Then, as in FIG. 2B, the terminals 13 are accommodated in the terminal accommodation portion 16, i.e. in the terminal housing 17. Then, this housing 17 is inserted in the terminal housing accommodation chamber 23 of the housing body 15, so that the soft sealing material 14 is pressed against the inner wall 11*a* and deformed into the sealing configuration.

As the terminal housing 17 is inserted in the terminal housing accommodation chamber 23, the front end 22*a* of the inner hood portion 22 (as an open end of the terminal housing accommodation chamber 23) abuts on the contact parts 13*a* of the terminals 13 in the terminal accommodation portion 16, thereby preventing the terminals 13 from slipping out.

According to the embodiment, as the soft sealing material 14 is inserted in the housing body 15 in advance and the terminals 13 are connected to the ends 12*a* of the wires 12 after the wires 12 are let through the soft sealing material 14, it is unnecessary to force the terminals 13 through the soft sealing material 14. As a result, the terminals 13 never scrape the soft sealing material 14 nor carry scraps thereof into the terminal accommodation portion 16. Accordingly, electrical performances are secured.

Further, in the embodiment, the wire insertion holes 21 formed through the wall 11*a* are each needed to have a sufficient size simply for one wire 12 to be let therethrough 21, and the soft sealing material 14 is kept free, even when the wire 12 is pulled obliquely, from undesirable deformations that cause gaps to be developed between the wire 12 and the soft sealing material 14. Therefor, the sealing performance of the waterproof connector can be secured.

Further, in the embodiment, when the terminal housing 17 is fitted in the housing body 15, the front end 22*a* of the inner hood portion 22 abuts on the contact parts 13*a* of the terminals 13, thereby preventing the terminals 13 from slipping out of the terminal accommodation portion 16, in addition to that the terminals 13 are retained in position by the locking engagement between the engagement lances 28 and the terminals 13. Accordingly, a conventional spacer is unnecessary, so that the number of component parts can be minimized. As a double locking or double engagement is achieved when the terminal housing 17 is fitted in the housing body 15, the number of assembling steps can also be reduced.

Further, in the embodiment, the soft sealing material 14 is compressed between the assembled terminal housing 17 and the inner wall 11*a*, and has an increased tendency to tight contact on outer circumferences of the wires 12 as well as on the inner wall 11*a*, thus permitting an improved waterproof performance.

According to an aspect of the embodiment, a waterproof connector comprises a housing, a terminal connected to an end of an electric wire and accommodated in the housing, and a soft sealing material accommodated in the housing and tight contacting on an outer circumference of the electric wire and on an inner wall of the housing, for sealing an inside of the housing, wherein: the housing comprises a housing body, and a terminal housing assembled to the housing body and provided with a terminal accommodation portion for accommodating the terminal; the housing body has a sealing material accommodation chamber for accommodating the soft sealing material, an insertion hole provided for passing the electric wire through the inner wall on which the soft sealing material accommodated in the sealing material accommodation chamber is tight contacting, and a terminal housing accommodation chamber communicating with the sealing material accommodation chamber and having the terminal housing fitted therein and pressing the soft sealing material toward the inner wall; and the terminal is connected to an end of the electric wire inserted through the insertion hole of the soft sealing material.

According to this aspect, in a waterproof connector, a terminal is connected to an end of a wire provided through a soft sealing material, and does not need to be passed through the soft sealing material. Therefore, the terminal will not scrape nor injure the soft sealing material.

Further, the soft sealing material is compressed between an inner wall of a housing body and a terminal housing, keeping the soft sealing material from slipping out. An insertion hole of the inner hole can have a sufficient sectional size simply for the wire to be let therethrough, and an insertion hole of the soft sealing material is substantially kept free from direct undue forces due to an oblique tension of the wire. As a result, maintained tight contact effectively prevents an occasional slip-in of water droplet.

According to another aspect, the terminal accommodation portion of the terminal housing comprises: a contact part accommodation chamber for accommodating a contact part of the terminal to be contacted with a mating terminal; and a wire accommodation groove for accommodating the electric wire and a wire connection part of the terminal connected to the end of the electric wire.

According to this aspect, in a waterproof connector, a soft sealing material is accommodated in a sealing material accommodation chamber of a housing body, a wire provided through a wire insertion hole is let through the soft sealing material, and an end of the wire is connected to a terminal. After the terminal is accommodated in a terminal accommodation portion, a terminal housing is accommodated in a terminal housing accommodation chamber, so that the terminal housing presses the soft sealing material against an inner wall, thus keeping the soft sealing material from slipping out of the housing body.

As the terminal housing presses the soft sealing material against the inner wall when the terminal housing is accommodated in the terminal housing accommodation chamber, the soft sealing material can be compressed in position by a single operation. As the soft sealing material is brought into tight contact on an outer circumference of the wire and on the inner wall of the sealing material accommodation chamber, a wire outlet space can be effectively sealed.

According to another aspect, in the waterproof connector, an open end of the terminal housing accommodation chamber abuts, at a side thereof where the terminal housing is inserted, on the contact part of the terminal in the contact part accommodation chamber of the terminal housing, as a stopper for preventing the terminal from slipping out of the terminal accommodation portion.

According to this aspect, in a waterproof connector, upon insertion of a terminal housing into a terminal housing accommodation chamber and fixation thereof, an open end of the terminal housing accommodation chamber, through which the terminal housing is inserted, abuts on a contact part of a terminal, thereby preventing the terminal from slipping out. In addition, an engagement lance prevents the terminal from slipping out from the terminal accommodation portion, as a measure therefor provided in the terminal housing, without needing a spacer for double engagement, resulting in a reduced number of component parts.

Further, another aspect of the embodiment provides a method for assembling the waterproof connector, comprising the steps of: inserting the soft sealing material in the sealing material accommodation chamber; inserting the electric wire in the housing body through wire insertion hole, letting through the soft sealing material, and pulling to a side of the terminal housing accommodation chamber; connecting the end of the wire to a wire connection part of the terminal; and inserting the terminal housing with the terminal accommodated in the terminal accommodation portion, into the terminal housing accommodation chamber, pushing the soft sealing material toward the inner wall.

According to this aspect, in a method for assembling a waterproof connector, a soft sealing material is inserted in a sealing material accommodation chamber and a wire is inserted in a housing body from a wire insertion hole. After the insertion into the housing body, the wire is let through the soft sealing material and drawn out to a terminal housing accommodation chamber side and connected to a wire connection part of a terminal. Then, a terminal housing with the terminal accommodated in a terminal accommodation portion is inserted into the terminal housing accommodation chamber and fixed therein. At this time, the terminal housing presses the soft sealing material to an inner wall side.

As the terminal is connected to the end of the wire after the soft sealing material is inserted in the housing body and let through the soft sealing material, it is unnecessary for the terminal to be forced through the soft sealing material. As a result, the soft sealing material is kept free from scrapes by the terminal, and is not injured. Accordingly, the electrical performance is improved, and the sealing performance is maintained.

According to another aspect, the method further comprises the step of bringing an open end of the terminal housing accommodation chamber in which the terminal housing is accommodated, into abutment on the terminal in the terminal accommodation portion to prevent the terminal from slipping out.

According to this aspect, when a terminal housing is inserted into a terminal housing accommodation chamber, an open end of the terminal housing accommodation chamber abuts on a terminal, thereby preventing the terminal from slipping out of a terminal accommodation portion.

Accordingly, upon insertion of the terminal housing into the terminal housing accommodation chamber, the open end of the terminal housing accommodation chamber abuts on the terminal, thereby preventing the terminal from slipping out of the terminal accommodation portion. Thus, in addition to engagement by an engagement lance, another engagement is effected for preventing the terminal from slipping out, thereby achieving a double engagement.

Therefore, a conventional spacer is unnecessary, and the number of component parts can be reduced. Further, the number of assembling steps can also be reduced, and associated fabrication costs can be reduced.

While the preferred embodiments of the present invention have been described using specific terms, such description is for illustrative purposes, and it is to be understood that changes and variations may be made without departing form the spirit or scope of the following claims.

What is claimed is:

1. A waterproof connector comprising a housing, a terminal connected to an end of an electric wire and accommodated in the housing, and a soft sealing material accommodated in the housing and in tight contact with an outer circumference of the electric wire and an inner wall of the housing, for sealing an inside of the housing, wherein:

the housing comprises a housing body, and a terminal housing assembled to the housing body and provided with a terminal accommodation portion for accommodating the terminal;

an open end of the terminal housing accomodation chamber configured to receive the terminal housing abuts the contact part of the terminal in the contact part accomodation chamber of the terminal housing, and acts as a stopper for preventing the terminal from slipping out of the terminal accomodation portion;

the housing body has a sealing material accommodation chamber for accommodating the soft sealing material, an insertion hole provided in the inner wall and configured to pass the electric wire through the inner wall with which the soft sealing material accommodated in the sealing material accommodation chamber is tight contact, and a terminal housing accommodation chamber communicating with the sealing material accommodation chamber, the terminal housing being fitted in the terminal housing accommodation chamber and compressing the soft sealing material against the inner wall and around the outer circumference of the electric wire; and the terminal is connected to an end of the electric wire inserted through the insertion hole of the soft sealing material.

2. The waterproof connector of claim 1, wherein the terminal accommodation portion of the terminal housing comprises:

a contact part accommodation chamber for accommodating a contact part of the terminal to be contacted with a mating terminal; and a wire accommodation groove for accommodating the electric wire and a wire connection part of the terminal to be connected to the end of the electric wire.

3. A method for assembling the waterproof connector of claim 1, comprising the steps of:

inserting the soft sealing material in the sealing material accomodation chamber;

inserting the electric wire into the housing body through the wire insertion hole, passing the wire through the soft sealing material, and pulling the wire to a side of the terminal housing accomodation chamber;

connecting the end of the wire to a wire connection part of the terminal;

inserting the terminal housing, with the terminal accommodated in the terminal accomodation portion, into the terminal housing accomodation chamber to push the soft sealing material toward the inner wall; and bringing an open end of the terminal housing accomodation chamber in which the terminal housing is accommodated, into abutment on the terminal in the terminal accommodation portion to prevent the terminal from slipping out.

4. A waterproof connector comprising a housing, a terminal connected to an end of an electric wire and accommodated in the housing, and a soft sealing material accommodated in the housing and in tight contact with an outer circumference of the electric wire and an inner wall of the housing, for sealing an inside of the housing, wherein:

the housing comprises a housing body, and a terminal housing assembled to the housing body and provided with a terminal accommodation portion for accommodating the terminal;

the housing body has a sealing material accommodation chamber for accommodating the soft sealing material, an insertion hole provided in the inner wall and configured to pass the electric wire through the inner wall with which the soft sealing material accommodated in the sealing material accommodation chamber is in tight contact, the inner wall including at least one projection configured to engage at least one slit in the soft sealing material, and a terminal housing accommodation chamber communicating with the sealing material accommodation chamber, the terminal housing being fitted in the terminal housing accommodation chamber and compressing the soft sealing material against the inner wall and around the outer circumference of the electric wire; and the terminal is connected to an end of the electric wire inserted through the insertion hole of the soft sealing material.

5. The waterproof connector of claim 4, wherein the terminal accommodation portion of the terminal housing comprises:

a contact part accomodation chamber for accommodating a contact part of the terminal to be contacted with a mating terminal; and a wire accommodation groove for accommodating the electric wire and a wire connection part of the terminal to be connected to the end of the electric wire.

6. The waterproof connector of claim 5, wherein an open end of the terminal housing accommodation chamber configured to receive the terminal housing abuts the contact part of the terminal in contact part accommodation chamber of the terminal housing, and acts as a stopper for preventing the terminal from slipping out of the terminal accommodation portion.

* * * * *

UNITED STATES PATENT AND TRADEMARK OFFICE

CERTIFICATE OF CORRECTION

PATENT NO. : 6,527,574 B1 
DATED : March 4, 2003
INVENTOR(S) : Takao Murakami et al.

It is certified that error appears in the above-identified patent and that said Letters Patent is hereby corrected as shown below:

Column 9,
Line 27, “accomodation” should read -- accommodation --;
Lines 29-30, “accomodation” should read -- accommodation --;
Line 32, “accomodation” should read -- accommodation --;
Line 38, “is tight” should read -- is in tight --.
Line 61, “accomodation” should read -- accommodation --;

Column 10,
Lines 4, 8 and 9, “accomodation” should read -- accommodation --;
Lines 11-12, “accomodation” should read -- accommodation --;
Line 48, “accomodation” should read -- accommodation --;
Line 54, “claim 5” should read -- claim 4 --.

Signed and Sealed this

Nineteenth Day of August, 2003

JAMES E. ROGAN
*Director of the United States Patent and Trademark Office*